United States Patent [19]

von Hein et al.

[11] 4,205,837

[45] Jun. 3, 1980

[54] APPARATUS FOR FORMING A SUCCESSION OF MUTUALLY OVERLAPPING PRODUCTS

[75] Inventors: Eduard von Hein; Kurt Rothen, both of Bern, Switzerland

[73] Assignee: Maschinenfabrik WIFAG, Bern, Switzerland

[21] Appl. No.: 895,108

[22] Filed: Apr. 10, 1978

[30] Foreign Application Priority Data

Apr. 12, 1977 [SE] Sweden ..... 7704188

[51] Int. Cl.[2] ..... B65H 5/34

[52] U.S. Cl. ..... 271/270; 271/315; 271/204; 271/277

[58] Field of Search ..... 271/80, 82, 151, 182, 271/204, 205, 206, 270, 277

[56] References Cited

U.S. PATENT DOCUMENTS

| | | | |
|---|---|---|---|
| 2,882,049 | 4/1959 | Koch | 271/206 |
| 3,076,492 | 2/1963 | Monks | 271/204 X |
| 3,487,447 | 12/1969 | Fusco | 271/80 X |
| 3,502,324 | 3/1970 | Billhofer | 271/82 |
| 3,719,267 | 3/1973 | Reist | 271/270 X |
| 4,000,864 | 1/1977 | Kurtz | 271/277 X |

*Primary Examiner*—Richard A. Schacher

*Attorney, Agent, or Firm*—Ostrolenk, Faber, Gerb & Soffen

[57] ABSTRACT

Apparatus for forming a succession of mutually overlapping products, like folded printed products: a vane wheel having a plurality of axially spaced apart vane discs; a respective chain extending between two neighboring discs; a set of item grippers along each chain; each chain passes between a sprocket located between the discs and a sprocket spaced away therefrom; the sprocket between two discs is eccentric of the discs and is supported on an arm which pivots with respect to the axis of the discs; each sprocket includes cams for opening each gripper as the gripper moves past, whereby each gripper grips a printed item as it leaves the vane wheel, carries the respective printed item to a transport so that the printed items are overlapped on the transport, and then releases the printed item.

20 Claims, 3 Drawing Figures

APPARATUS FOR FORMING A SUCCESSION OF MUTUALLY OVERLAPPING PRODUCTS

BACKGROUND OF THE INVENTION

1. Field of the Invention

The invention relates to an apparatus for forming a succession of mutually overlapping products, and particularly folded printed products, and the invention particularly relates to such an apparatus which comprises at least one chain, which is equipped with grippers for gripping individual products, and which chain is guided next to a vane wheel of a folding apparatus for automatically guiding the products to be overlapped out of the vane wheel and for passing the products to a transfer station in an overlapping arrangement.

2. Description of the Prior Art

To enable further mechanical processing of printed products, and particularly thin printed products, they often should be arranged in a mutually overlapping arrangement. Other items may also have to be placed in a mutually overlapping formation. For proper overlapping, the overlap spacing must have a distribution range that does not exceed a certain maximum.

Printed products are delivered to a transport for being overlapped by a vane wheel, comprised of one or a plurality of coaxial, same size, axially spaced discs, each having a respective plurality of vanes or fingers projecting from the surface of the disc and partially wrapped about and spaced away from the surface of the disc. Strippers remove each product from the vane wheel in its turn and deposit it on a transport in an overlapping manner with respect to the next preceding product.

To provide overlapped, folded printed products, overlap spacing of the required accuracy cannot be realized with strippers which are conventionally provided for cooperation with a vane wheel. This is because the folded products rebound at too high a speed from the stripper units. Consequently, the folded products accumulate between the vanes of the vane wheel and the stripper units and lose contact with the vanes. Furthermore, during the further delivery process, the products no longer follow the stripper units with the required accuracy of timing. This produces differences in the overlap spacing that exceed a permissible amount.

A relatively insignificant improvement in delivery can be achieved through optimal shaping of the vane. Further, it is possible to reduce the speed of rebound of the printed products or items on the stripper units by increasing the number of vanes on the vane wheel. However, these expedients do not ensure the required delivery tolerances for operation at the high operating speeds which are usual today.

U.S. Pat. No. 3,390,508 discloses apparatus for automatically guiding the printed products or other items out of the vane wheel by means of a chain which is equipped with grippers. In principle, accurate overlap spacing is attainable using this apparatus. But, this apparatus is not concerned with forming a succession of mutually overlapping printed items. Further, in this apparatus, because the chain is guided concentrically, and not eccentrically, about the axis of rotation of the vane wheel, the chain spacing or the gripper spacing must be selected in accordance with the vane spacing at the bases of the vanes on the peripheral surface of the vane wheel. If it were desired to use this apparatus to place a succession of mutually overlapping printed items on a receiving means or transport belt, it would be impossible to bring the product overlap spacing to the required, relatively small dimension.

SUMMARY OF THE INVENTION

The invention provides an apparatus for forming a succession of mutually overlapping products, and particularly folded printed products. The apparatus comprises at least one chain, which is equipped with a succession of spaced apart grippers and which is guided next to at least one disc of a vane wheel, and more particularly, which is guided between two axially spaced apart discs of a vane wheel of folding equipment. The grippers automatically guide the folded printed items out of the vane wheel and thereafter pass them to a transfer station. The chain is guided around a first guide wheel. This guide wheel is rotatably mounted on an arm by which the guide wheel is held axially parallel to the axis of the vane wheel but the guide wheel is held eccentric to the vane wheel axis. The arm is adjustably supported on a pin and extends, like the guide wheel and chain it supports, next to at least one disc of the vane wheel, and more particularly between two discs of the vane wheel. Each chain passes between the first guide wheel, which is at the vane wheel, and a second guide wheel that is spaced away from the first guide wheel.

Means are located on each of the guide wheels for opening the normally closed grippers. When the grippers are opened by the first guide wheel, the folded printed items are gripped by the grippers and are removed from the vane wheel. The items are then transported toward the second drive wheel by the chain. During this travel, the items are laid onto a transport means in a mutually overlapping manner. Then, when the printed items and the grippers reach the second guide wheel, the grippers are opened and release the printed items.

The apparatus of the invention automatically leads the folded printed items out of the vane wheel of the folding equipment and ensures there is the small overlap spacing, which conforms to set tolerances.

It is the primary object of the invention to form a succession of mutually overlapping printed products which are at a desired overlap spacing.

It is another object of the invention to cause the overlap spacing to be at a desired level, and perhaps a small amount.

Other objects and features of the invention will be understood from the following description and the accompanying drawings.

DESCRIPTION OF A PREFERRED EMBODIMENT

Figure 1:
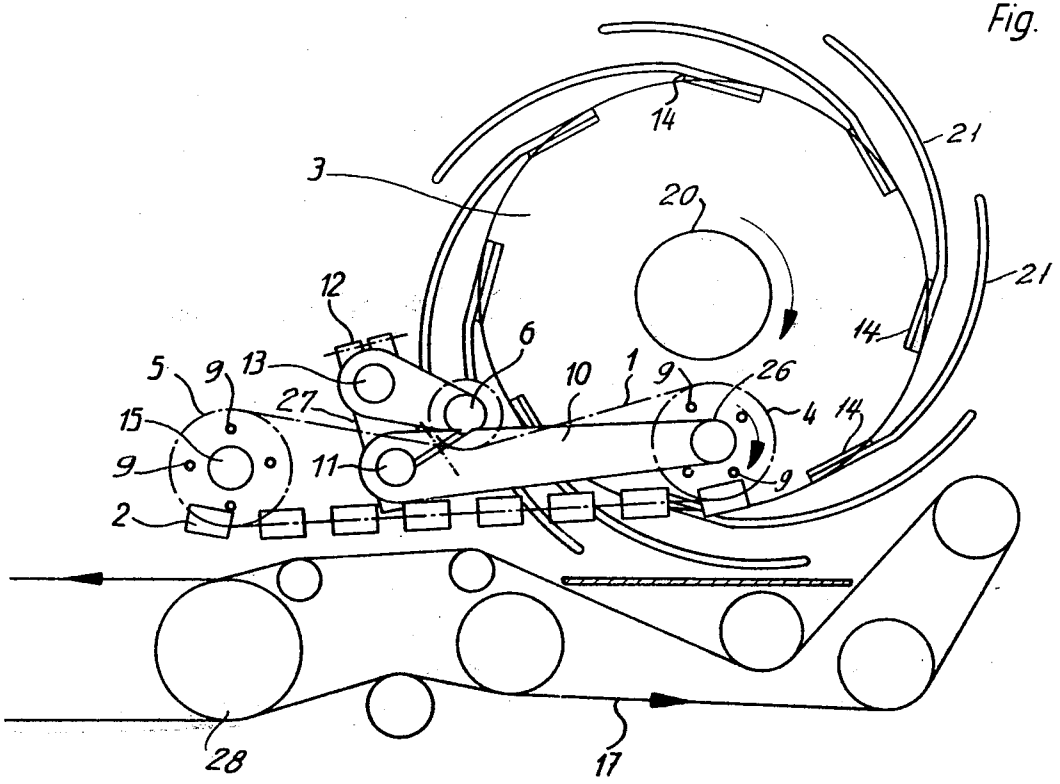
FIG. 1 is a schematic side elevational view of the apparatus of the invention.
Figure 2:
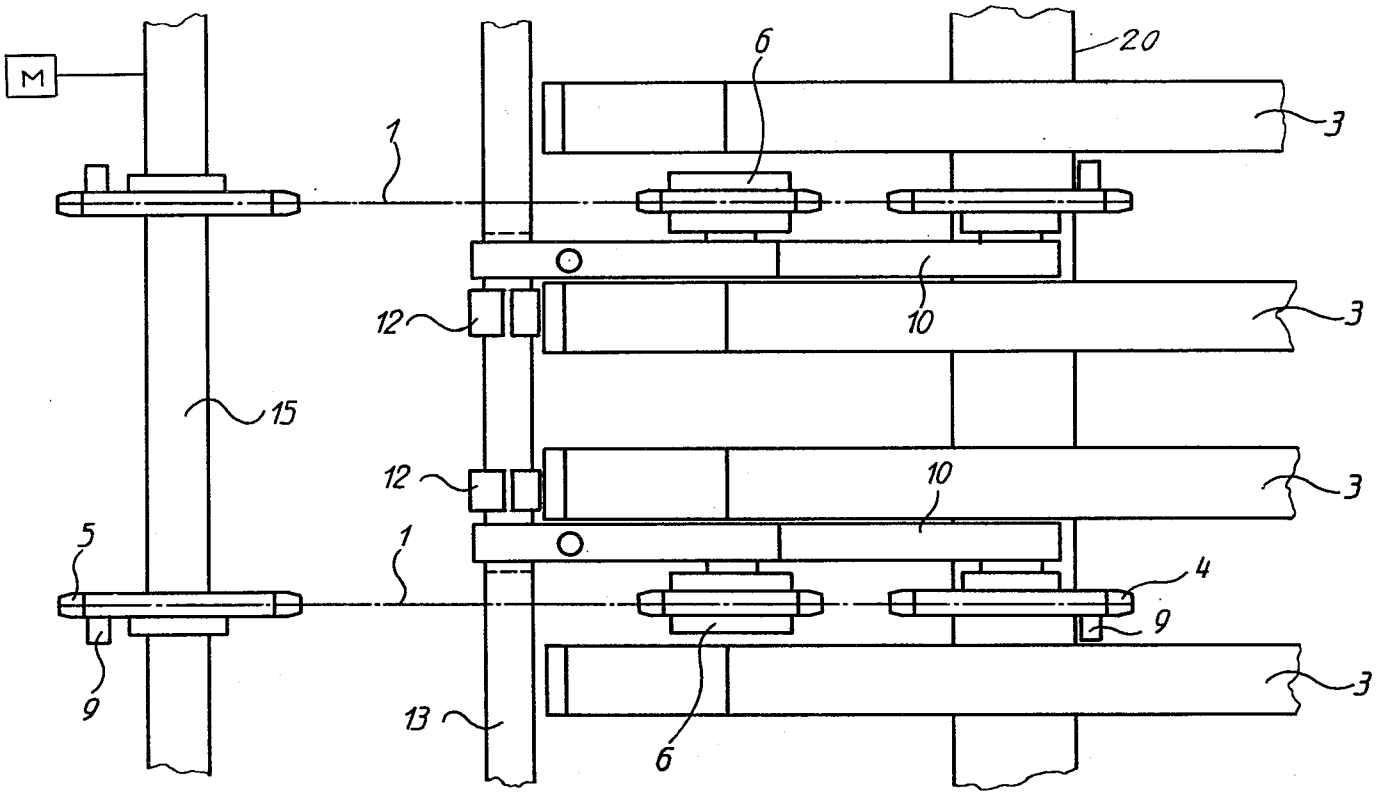
FIG. 2 is a schematic plan view of the apparatus shown in FIG. 1.
Figure 3:
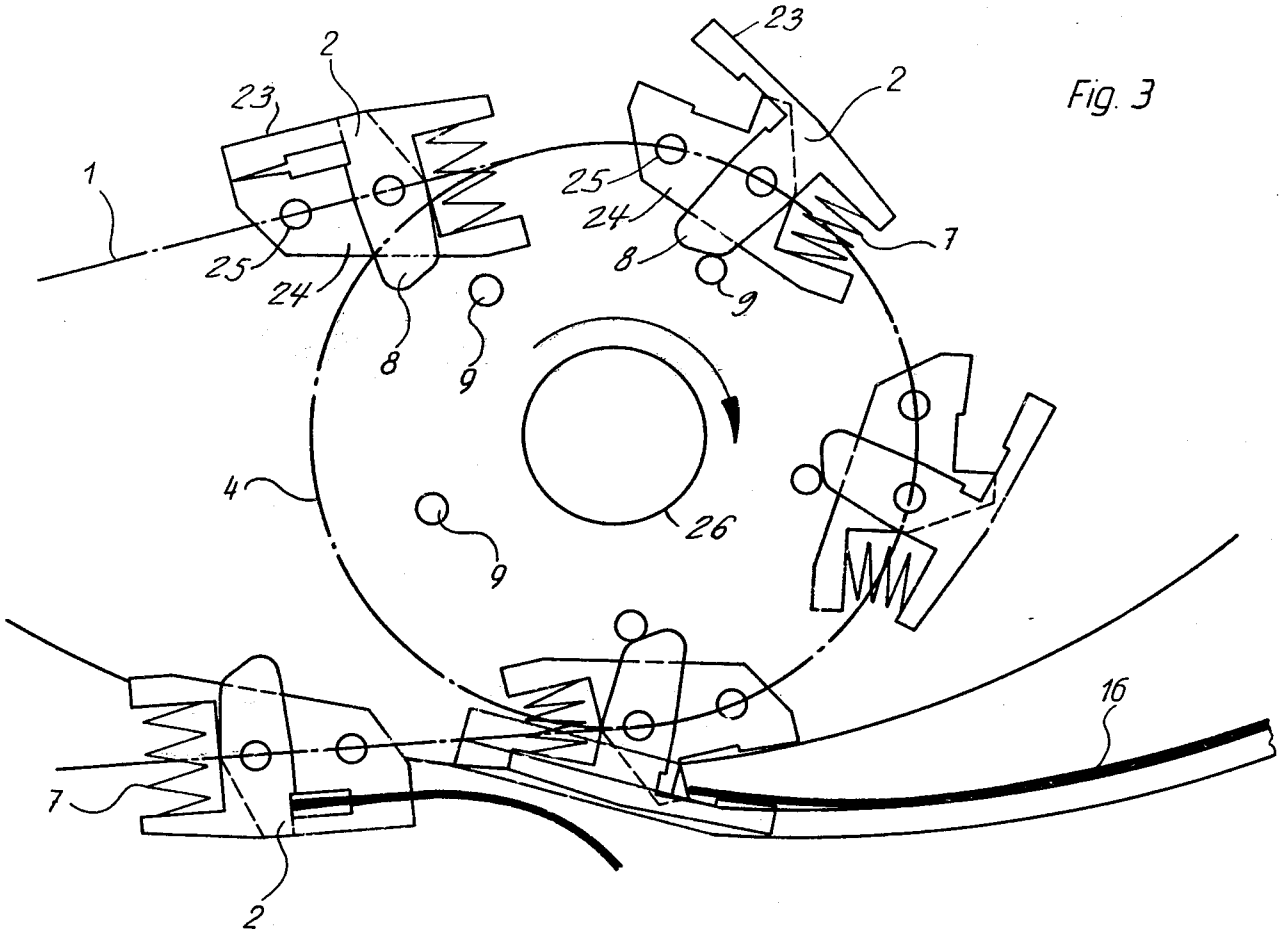
FIG. 3 is an enlarged fragment of FIG. 1, showing grippers and their actuation.

Referring to FIG. 2, a plurality of parallel, spaced apart chains 1, with two chains 1 being illustrated, are provided. It is apparent that a greater number of chains would be provided with a wider apparatus. As shown in FIGS. 1 and 3, each chain 1 carries grippers 2 at regularly spaced intervals, which correspond to the desired overlap spacing.

Each chain 1 passes between the individual discs 3 of a vane wheel. All discs 3 are of the same diameter and are coaxially supported on the common axis 20, which is held at a fixed location during operation of the apparatus. Each vane wheel disc 3 carries a plurality of vanes 21 which are attached to the periphery of the disc 3 at the bases 14 of the vanes 21, and the vanes wrap partially around the peripheries of their discs.

Each chain 1 runs around a first sprocket guide wheel 4 that is located between the discs 3 and a second spaced away sprocket guide wheel 5. Each chain 1 is tensioned by a respective tensioning device 6 comprising a roller that is spring biased against the chain.

Referring to FIG. 3 for causing each gripper 2 to exert a closure force, the gripper is comprised of two pivotally attached fingers 23 and 24, with one finger 24 being fixed to the chain 1 at 25. A compression spring 7 is installed between the fingers so that the spring is charged when the fingers of the gripper 2 are separated. Separation or opening of the fingers 23, 24 occurs as the gripper lever 8, which is attached to one of the fingers 23 of the gripper, is moved by the chain 1 until the lever 8 abuts one of the cams 9 which are arranged on both of the sprocket guide wheels 4 and 5. A necessary condition for this is that the number of teeth of the sprocket guide wheels 4, 5 is an integral multiple of the chain length spacing allocated to the distance between the grippers. When a lever 8 abuts a cam 9, it pivots the respective finger 23 of the gripper 2 against the force of the spring 7 to separate the gripper fingers.

Each first sprocket guide wheel 4 is rotatably mounted at pivot 26 on a respective arm 10. The arm 10 is adjustably fixed on a pin 11, which is mounted in a lever 27, which in its turn is adjustably fixed on a pin 13. By appropriate adjustment and affixation of the arm 10 and the lever on pins 11 and 13, it is possible to accurately direct the sprocket guide wheel 4 and the grippers 2 toward the bases 14 of the vanes 21 and to have the gripper guide wheel 4 be eccentric with respect to the vane wheel discs 3.

All of the second sprocket guide wheels 5 are mounted on a common fixedly located shaft 15. The shaft is driven by motor M in a known but not illustrated way, at a fixed speed ratio to the drive of the vane wheel discs 3.

The spacing between the grippers 2 on the chain 1 is smaller than the spacing between the vanes 21 at their bases 14. Therefore, the chain speed must also be lower than the circumferential speed of the vane wheel at the base 14 of the vanes, in order that the printed items 16 will be accurately gripped and, hence, the overlap spacing will be accurately controlled.

After the printed items 16 are gripped by a gripper 2, as shown in FIG. 3, they are released by the respective vane 21 on the wheel, and while still being held by the gripper, they are permitted to settle onto a delivery conveyor unit 17, forming a succession of mutually overlapping printed items 16 on the known conveyor unit 17. The conveyor unit comprises an endless belt which passes over a series of guide rollers and a motor driven roller, like roller 28. The belt of the conveyor unit runs at the same speed as the chains. As the printed items and the grippers move past the second sprocket guide wheel 5, the printed items 16 are released by the grippers 2, which grippers are reopened by the cams 9 on the wheel 5.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. Apparatus for forming a succession of mutually overlapping products comprising:

a rotatable vane wheel; said vane wheel having an axis of rotation; said vane wheel having vanes thereon;

a first guide wheel having a respective rotation axis; said first guide wheel axis being offset from said vane wheel axis; said first guide wheel being generally next to a portion of said vane wheel;

a chain placed near to said vane wheel; said chain having a plurality of product grippers thereon for gripping products held in said vane wheel; said chain passing around and being guided by said first guide wheel; means for driving said chain to move past said first guide wheel; said first guide wheel and said chain therefor being so placed with respect to said vane wheel that said grippers each remove a product from a respective said vane as each said gripper moves by the respective said vane;

an arm adjustably positionable to various positions with respect to its spacing from said vane wheel axis; said first guide wheel rotation axis being carried on and being movable with said arm.

2. The apparatus of claim 1, wherein said arm has a support mount therefor that is spaced from said first guide wheel, and said arm being shiftable about said support mount therefor to move said first guide wheel to different positions with respect to said vane wheel axis.

3. The apparatus of either claims 1 or 2, wherein said vane wheel is comprised of a plurality of spaced apart discs, which are rotatable together around said vane wheel axis; a said chain passes between each pair of said plurality of vane wheel discs; the respective said first guide wheel for each said chain being located between the respective said pair of discs.

4. The apparatus of claim 1, further comprising means for driving said first guide wheel and said chain to rotate at a fixed rotation rate in comparison with the rotation rate of said vane wheel.

5. The apparatus of claim 4 wherein said vanes all have bases at which they are attached on said vane wheel; said driving means for said first guide wheel driving said first guide wheel at a lower speed than the circumferential speed of said vane wheel at said bases of said vanes.

6. The apparatus of claim 1, further comprising a second drive wheel remote from said first drive wheel; said chain also passing around and being guided by said second drive wheel.

7. The apparatus of claim 6 further comprising first gripper opening means on said first guide wheel for opening said grippers as said chain passes said first guide wheel, thereby enabling said grippers to grip product on a said vane and to carry the product, along with said gripper on said chain, away from the said vane from which the product had been gripped.

8. The apparatus for claim 7 further comprising a second gripper opening means at said second guide wheel for opening said grippers and for releasing a product after it has been carried by said gripper away from a said vane that had held the product.

9. The apparatus of claim 8 further comprising product transport means so placed and movable that products held by said grippers, may, in turn, move onto said transport means in overlapping manner; said transport means being shaped and positioned such that the product released by said gripper may thereafter remain on said transport means.

10. The apparatus for claim 9 further comprising means for moving said transport means generally along the direction of and at the same speed as said chain such that products held by the grippers may establish their overlapping relationship while they are still gripped by said grippers and may retain that relationship after they are released.

11. The apparatus of either of claims 8 or 9, wherein said first and second gripper opening means both comprise respective gripper engaging cams on said first and said second guide rollers; said grippers including cam followers for engaging said cams and for being opened upon engagement with said cams.

12. The apparatus of claim 11, wherein each said gripper comprises a pair of pivotable fingers pivotally connected together; means normally biasing said fingers together to grip; a said cam follower being connected with said fingers for being operated to separate said fingers, thereby to release product gripped by said fingers.

13. The apparatus of claim 1, further comprising first gripper opening means on said first guide wheel for opening said grippers as said chain passes said first guide wheel, thereby enabling said grippers to grip product on a said vane and to carry the product, along with said gripper on said chain, away from the said vane from which the product had been gripped.

14. The apparatus of claim 13, further comprising second gripper opening means remote from said first guide wheel for opening said grippers and for thereby releasing a product after it has been carried by a said gripper away from the said vane that had held the product.

15. The apparatus of claim 14, further comprising product transport means so placed and movable that products held by said grippers may, in turn, move onto said transport means in overlapping manner; said transport means being shaped and positioned such that the product released by said gripper may thereafter remain on said transport means.

16. Apparatus for forming a succession of mutually overlapping products comprising:

a rotatable vane wheel; said vane wheel having an axis of rotation; said vane wheel being comprised of a plurality of spaced apart discs, which are rotatable together around said vane wheel axis; said vane wheel discs having vanes thereon;

a first guide wheel in the space between each pair of said vane wheel discs; all said first guide wheels having a rotation axis; said first guide wheel axis being offset from said vane wheel axis;

a respective chain being placed near to said vane wheel and passing in the space between each pair of said vane wheel discs; each said chain having a plurality of product grippers thereon for gripping products held in said vane wheel; each said chain passing around and being guided by a respective said first guide wheel; means for driving said chain to move past said first guide wheel; each said first guide wheel and said chain therefor being so placed with respect to said vane wheel that said grippers each remove a product from a respective said vane as each said gripper moves by the respective said vane;

first gripper opening means on said first guide wheels for opening said grippers as said chains pass said first guide wheels, thereby enabling said grippers to grip product on a said vane and to carry the product, along with said grippers on said chains, away from the said vane from which the product had been gripped;

second gripper opening means remote from said first guide wheels for opening said grippers and for thereby releasing a product after it has been carried by said gripper away from the said vane that had held the product.

17. The apparatus of claim 16, further comprising product transport means so placed and movable that products held by said grippers, may, in turn, move into said transport means in overlapping manner; said transport means being shaped and positioned such that the product released by said gripper may thereafter remain on said transport means.

18. The apparatus of claim 16, further comprising a respective second drive wheel remote from each said first drive wheel; each said chain also passing around and being guided by the respective said second drive wheel;

second gripper opening means at each said second guide wheel and remote from the respective said first guide wheel for opening said grippers and for releasing a product after it has been carried by said grippers away from the said vane that had held the product.

19. The apparatus of claim 18, wherein said first and second gripper opening means both comprise respective gripper engaging cams on said first and said second guide rollers; said grippers including cam followers for engaging said cams and for being opened upon engagement with said cams.

20. The apparatus of claim 19, wherein each said gripper comprises a pair of pivotable fingers pivotally connected together; means normally biasing said fingers together to grip; a said cam follower being connected with said fingers for being operated to separate said fingers, thereby to release product gripped by said fingers.

* * * * *